US008019236B2

(12) United States Patent
Abe

(10) Patent No.: US 8,019,236 B2
(45) Date of Patent: Sep. 13, 2011

(54) IMAGE FORMING DEVICE CAPABLE OF PROPERLY CHECKING REMOVAL OF PAPER THAT CAUSED A PAPER JAM IN A FIXING PART

(75) Inventor: Hiroshi Abe, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 874 days.

(21) Appl. No.: 11/974,805

(22) Filed: Oct. 16, 2007

(65) Prior Publication Data

US 2008/0095546 A1 Apr. 24, 2008

(30) Foreign Application Priority Data

Oct. 23, 2006 (JP) ..... 2006-287990

(51) Int. Cl.
*G03G 15/00* (2006.01)

(52) U.S. Cl. ..... 399/21; 399/67; 399/122; 399/320; 399/322; 399/400

(58) Field of Classification Search ..... 399/21, 399/33, 400, 67, 68, 69, 320, 322, 122
See application file for complete search history.

(56) References Cited

U.S. PATENT DOCUMENTS

| | | | | |
|---|---|---|---|---|
| 5,300,981 | A * | 4/1994 | Shioya | 399/33 |
| 5,708,910 | A * | 1/1998 | Fukano et al. | 399/21 |
| 6,556,794 | B2 * | 4/2003 | Miura | 399/18 |
| 2006/0198666 | A1 * | 9/2006 | Kondoh et al. | 399/307 |

FOREIGN PATENT DOCUMENTS

| | | | |
|---|---|---|---|
| JP | 04158386 | A * | 6/1992 |
| JP | 2001-350358 | | 12/2001 |
| JP | 2002-189398 | | 7/2002 |
| JP | 2003-323068 | | 11/2003 |
| JP | 2005-234064 | | 9/2005 |

* cited by examiner

*Primary Examiner* — Matthew G Marini
(74) *Attorney, Agent, or Firm* — Jordan and Hamburg LLP

(57) ABSTRACT

An image forming device is provided that is capable of properly checking removal of a paper that has caused a paper jam in a fixing part. The fixing part includes transporting mechanisms for transporting a paper on which a toner image is formed. A first paper detecting part is disposed on an upstream side of the fixing part. A second paper detecting part is disposed on a downstream side of the fixing part. A paper jam detecting part detects paper jams in the fixing part. A transportation control part drive-controls the transporting mechanisms to change a transporting direction of the paper to a reverse direction when a paper jam in the fixing part is detected and the paper is not detected by the first detecting part.

16 Claims, 7 Drawing Sheets

IMAGE FORMING DEVICE CAPABLE OF PROPERLY CHECKING REMOVAL OF PAPER THAT CAUSED A PAPER JAM IN A FIXING PART

This application is based on an application No. 2006-287990 filed in Japan, the contents of which are hereby incorporated by reference.

BACKGROUND OF THE INVENTION

1. Field of the Invention

The present invention relates to an image forming device that includes a heat fixing mechanism, such as a copying machine, a facsimile machine, a printer, or the like. More specifically, the present invention relates to an image forming device that is capable of detecting a paper jam in the heat fixing mechanism.

2. Description of the Related Art

In an electrophotographic-type image forming device, output image data is generated by applying prescribed image processing on manuscript image data that is read by an image reading part, light beams modulated based on the output image data are irradiated on a surface of a photoreceptor that is charged uniformly, an electrostatic latent image formed on the photoreceptor is developed with toners, a toner image obtained thereby is transferred from the photoreceptor to a paper, the toner image on the paper is then thermally fixed at a fixing part, and the paper is discharged.

The fixing part is constituted with: a fixing roller that includes a heater inside thereof and a pressure roller that is disposed in a coaxial direction with respect to the fixing roller to press a paper against the fixing roller. A paper to which a toner image is transferred is sandwiched between the fixing roller and the pressure roller, and transported from an upstream side of a transporting path of the paper towards a downstream side thereof while being heated under a pressure. That is, the fixing part has a function of thermally fixing the toner image to the paper as well as a function of transporting the paper. Further, there is also a fixing part including a fixing belt in a belt-like form that is different from the fixing roller. However, the functions thereof are the same as the functions of the fixing roller described above.

In general, the image forming device is provided with a paper detecting part for detecting a paper that passes through the fixing part, and a paper jam detecting part for detecting an occurrence of a paper jam based on a detection state of the paper detected by the paper detecting part. This makes it possible to detect occurrences of abnormal states, e.g. a state where a paper is wrapped around the fixing roller or the pressure roller, and a state where a paper is stuck within the fixing part.

When the paper jam detecting part detects a paper jam, the heater of the fixing roller is turned off and the image forming device is stopped at the same time. It is then controlled to wait until the paper within the fixing part is removed.

Further, if the image forming device is returned to a normal state without removing the paper stuck in the fixing part, a paper transported thereafter is also stuck in the fixing part, which gives critical damages to the fixing part, or deteriorates the paper-jam state so that it becomes difficult to remove the papers. Therefore, when the image forming device is returned to the normal state after the occurrence of the paper jam in the fixing part, a paper detecting sensor detects whether or not there is a remaining paper.

However, the paper detecting part is disposed away from the fixing roller in order to avoid an influence of a high temperature from the fixing part. Thus, when a paper jam is detected at the paper jam detecting part, there is a high possibility for a rear end of a long paper to be detected by the paper detecting part, while there is a low possibility for a short paper to be detected because a rear end of the short paper may already have passed the paper detecting part at a point where the paper jam is detected. In such cases, it is also difficult for an operator to visually check the paper. Therefore, the image forming device is returned to the normal state without having the paper removed, which may result in causing the above-described problems.

Japanese Unexamined Patent Publication No. 2002-189398 discloses an image forming device which includes: a fixation roller for fixing a toner image that is formed on a transfer paper to the transfer paper by heating and pressurizing it with a fixing roller and a pressure roller; roller driving means capable of changing a drive speed for rotationally driving the fixation roller forwardly and backwardly; and downstream-side jam detecting means for detecting a paper jam in a paper transporting path on a downstream side with respect to the fixation roller, wherein, when a jam of a paper tip is detected by the downstream-side jam detecting means, a drive of the fixation roller is stopped after it is driven at a lower speed than a speed at the time of forming an image and driven in an opposite direction with respect to a direction at the time of forming the image.

However, as in the image forming device depicted in Japanese Unexamined Patent Publication No. 2002-189398, to drive the fixation roller in a reverse direction indiscriminately upon detecting a paper jam is not a solution to sufficiently overcome such problems, i.e. the fixation roller is damaged depending on the paper jam state, and the paper jam state is deteriorated so that it becomes difficult to remove the paper.

SUMMARY OF THE INVENTION

In view of the above-described problems, an object of the present invention therefore is to provide an image forming device that is capable of properly checking removal of a paper that has caused a paper jam, when there is a paper jam occurred in a fixing part.

An image forming device according to the present invention includes: a fixing part having a transporting mechanism which transports a paper on which a toner image is formed towards a downstream side while thermally fixing the toner image; a first paper detecting part disposed on an upstream side of the fixing part; a second paper detecting part disposed on a downstream side of the fixing part; a paper jam detecting part which detects a paper jam in the fixing part when a paper is not detected by the second paper detecting part within a first prescribed time after the paper is detected by the first paper detecting part; and a transportation control part which drive-controls the transporting mechanism to change a transporting direction of the paper to a reverse direction, when a paper jam in the fixing part is detected by the paper jam detecting part and the paper is not detected by the first paper detecting part.

Further, other aspects of the present invention will become clear by referring to embodiments provided hereinafter.

DESCRIPTION OF THE PREFERRED EMBODIMENTS

As a way of example, an electrophotographic-type digital copying machine will be described hereinafter as an image forming device with which the present invention is embodied.

Figure 2:
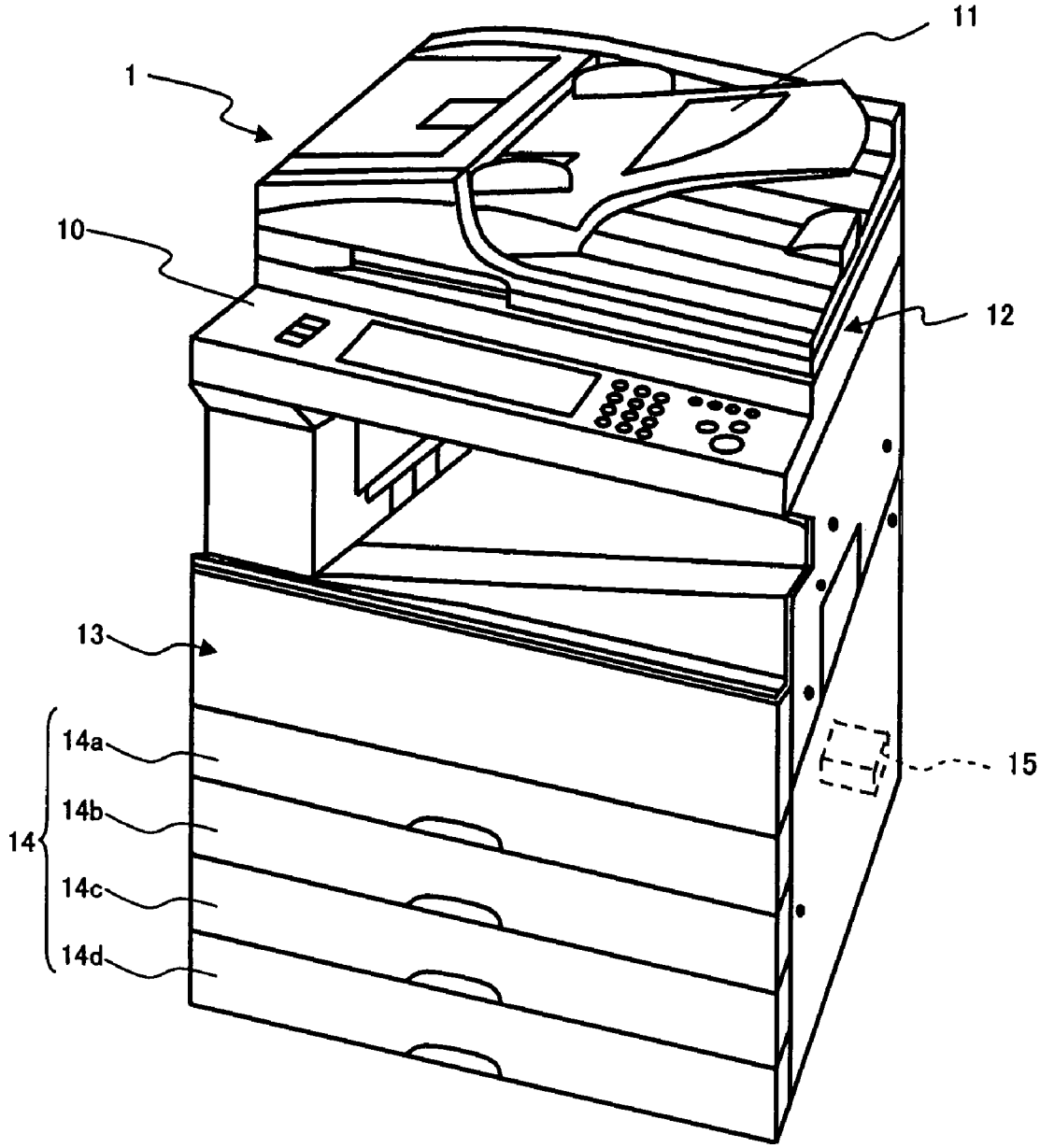
FIG. 2 is an external appearance of an image forming device.

As shown in FIG. 2, a digital copying machine 1 includes: an operation part 10 that includes a color display part, hardware keys, and the like; an image reading part 12 that reads a series of manuscripts set in a manuscript loading part 11 and converts the manuscripts to electronic data; an image processing part that generates output image data by applying prescribed image processing on image data that is read by the image reading part 12; an image output part 13 that forms a toner image based on the output image data generated by the image processing part, transfers the toner image to a paper, and outputs the paper; paper feeding cassettes 14 in which papers are stored; and the like.

Figure 3:
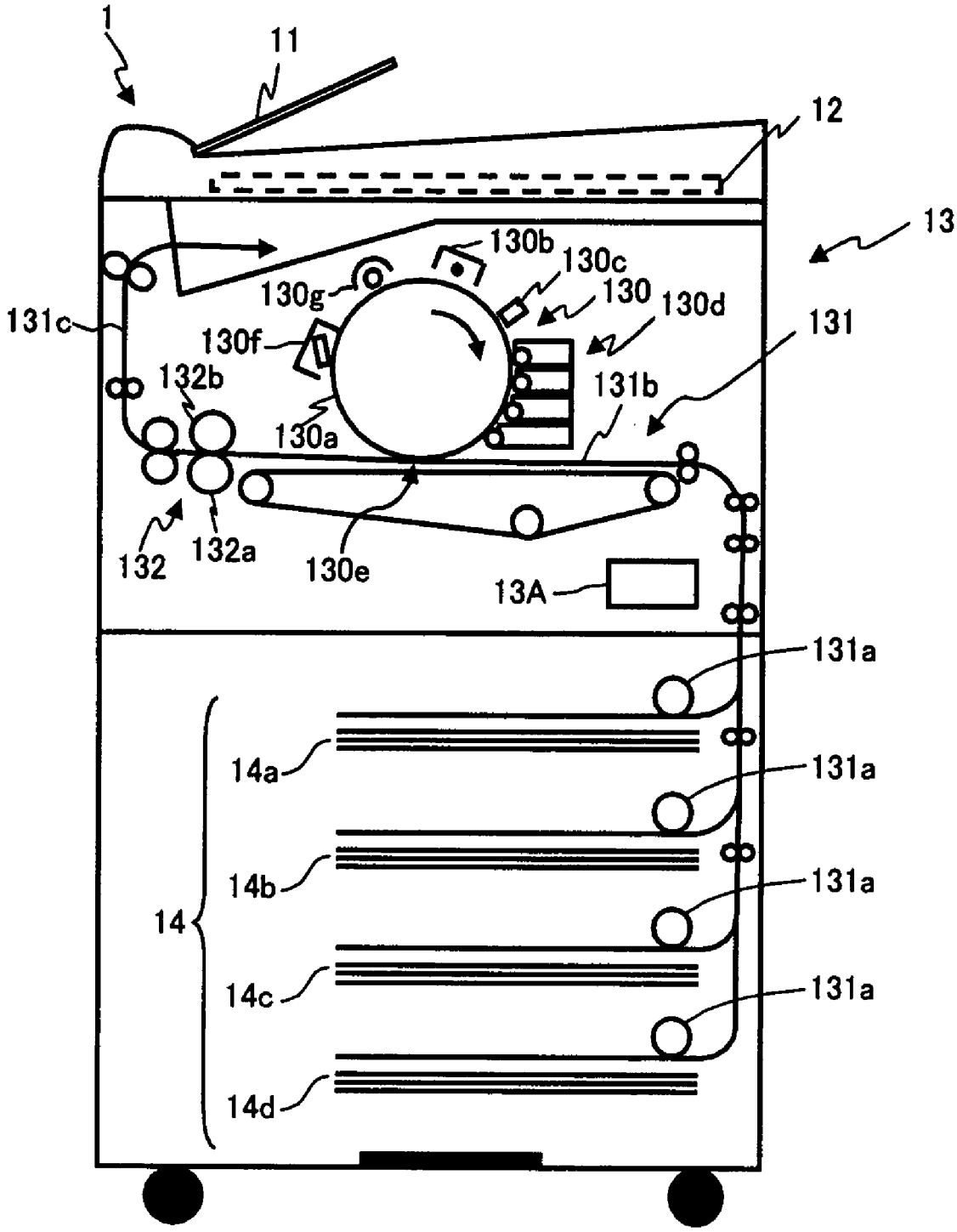
FIG. 3 is a cross-sectional block diagram of the image forming device.

As shown in FIG. 3, the image output part 13 includes: a transporting part 131 for transporting the stored papers from the paper feeding cassettes 14; an image forming part 130 that forms a toner image on the paper transported by the transporting part 131 based on the output image data generated by the image reading part 12; a fixing part 132 that thermally fuses and fixes the toner image formed on the paper; and the like.

A photoreceptor 130*a* is provided to the image forming part 130, and arranged along the periphery of the photoreceptor 130*a* are: an electrostatic charger 130*b* for uniformly corona-charging the surface of the photoreceptor 130*a*; a print head 130*c* for forming an electrostatic latent image by exposing the charged photoreceptor 130*a*; a developing part 130*d* for developing a toner image by electrostatically attaching toners to the formed electrostatic latent image; a transferring part 130*e* for transferring the developed toner image to the paper; a cleaning part 130*f* for removing the toners remained on the photoreceptor 130*a* after the transfer; and a static eliminating lamp 130*g* for eliminating a remaining potential on the surface of the photoreceptor 130*a* to make it uniform.

Developing blocks with four-colors of toners, cyan, magenta, yellow, and black are provided in the developing part 130*d*. Images formed with those toners are superimposed one after another on the photoreceptor 130*a* to form a color image.

The transporting part 131 is provided with: a paper feeding/transporting part 131*a* that transports the papers one by one from one of a plurality of paper feeding cassettes 14 in which papers of different sizes from each other are stored; a transferring/transporting part 131*b* which transports the paper fed by the paper feeding/transporting part 131*a* to the transferring part 130*e*, and transports the paper to which the toner image is transferred by the transferring part 130*e* towards the fixing part 132; and a paper discharge part 131*c* for discharging the paper that has passed through the fixing part 132 in a face-down manner.

Figure 1:
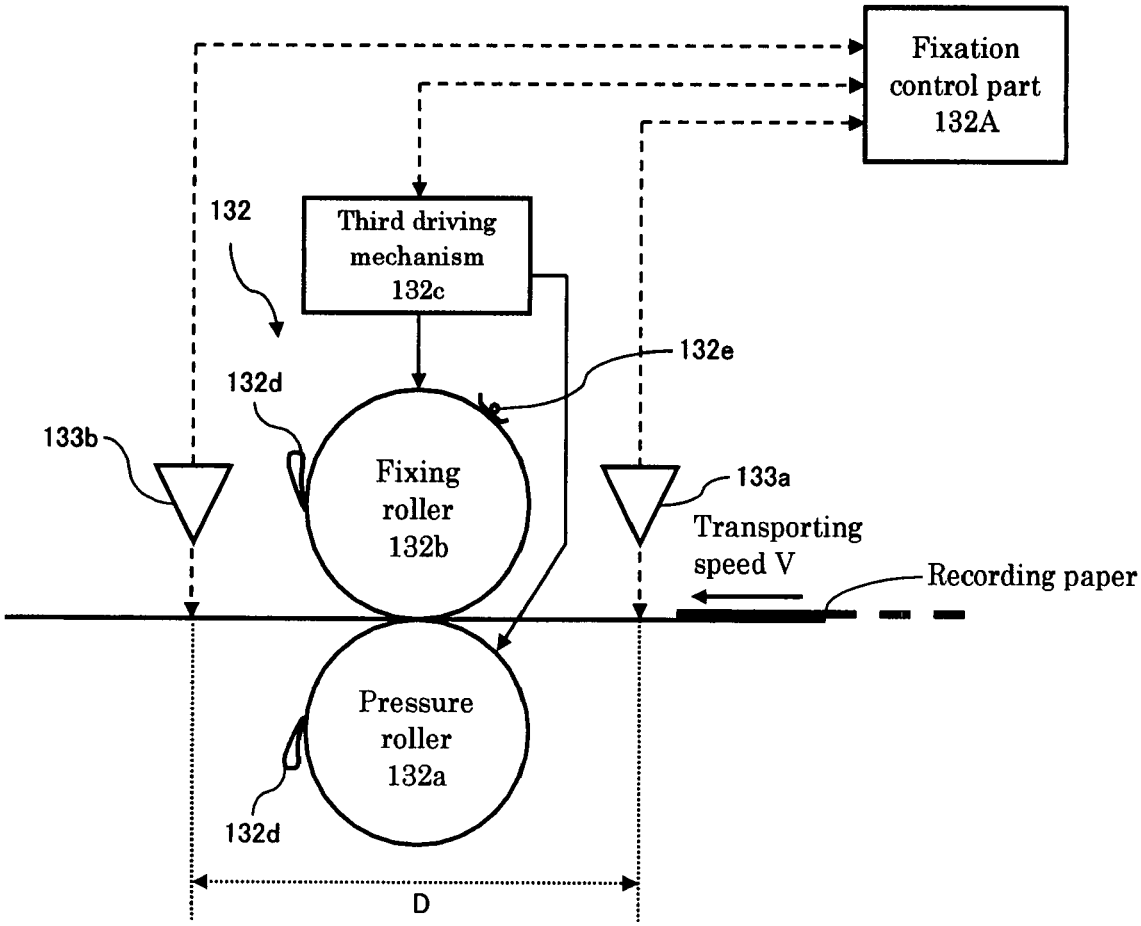
FIG. 1 is an illustration for describing a fixing part.

As shown in FIG. 1, the fixing part 132 is provided with a fixing roller 132*b* and a pressure roller 132*a* which constitute a transporting mechanism of the present invention. A heater is disposed within the fixing roller 132*b*, and the pressure roller 132*a* is disposed to be energized by the fixing roller 132*b* by a prescribed pressure. Further, a thermistor 132*e* for detecting a temperature of the fixing roller 132*b* is disposed by being in contact with the fixing roller 132*b*, and a pair of separation claws 132*d* for preventing twining of the transported papers are provided to the fixing roller 132*b* and the pressure roller 132*a*.

Along with the other control parts that control the image reading part 12 and the like, an image output control part 13A that is generally controlled by a system control part 15 shown in FIG. 2 is provided to the digital copying machine 1. Like the other control parts, the image output control part 13A is constituted with a CPU, a ROM where operation programs of the CPU are stored, a RAM to be a work area, and the like.

Figure 4:
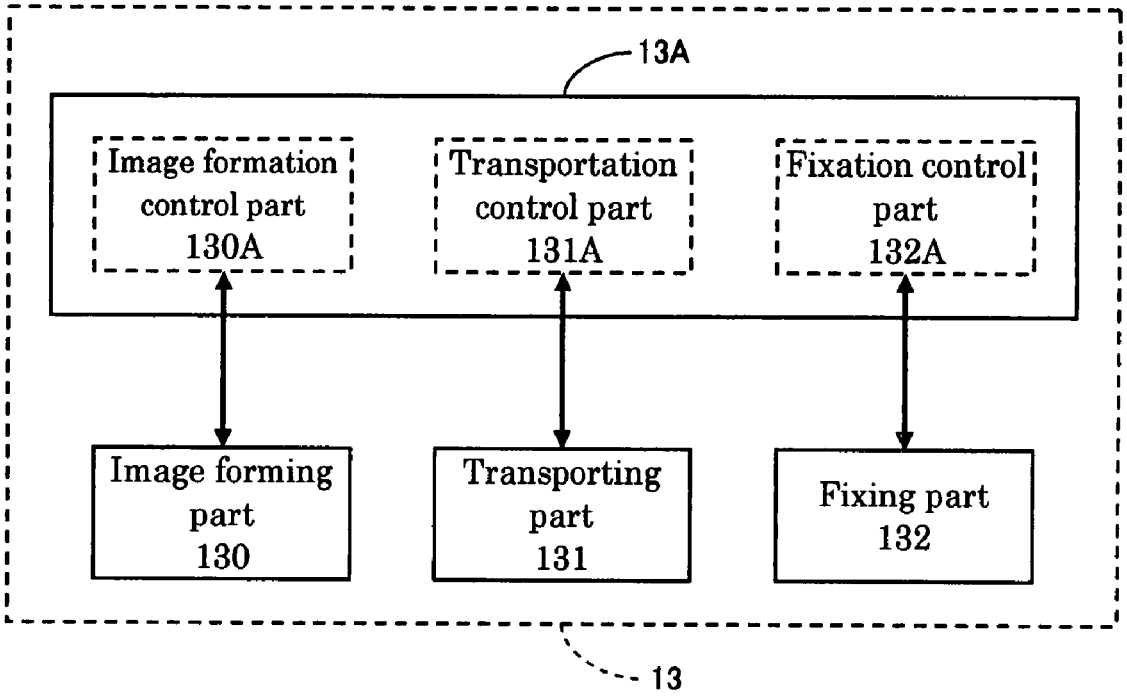
FIG. 4 is a block diagram of an image output control part.

As shown in FIG. 4, the image output control part 13A includes each of functional blocks such as an image formation control part 130A, a transportation control part 131A, and a fixation control part 132A. The image formation control part 130A controls the image forming part 130, the transportation control part 131A controls the transporting part 131 to transport the papers, and the fixation control part 132A controls the temperature of the fixing part 132 as well as transportation and the like of the papers in the fixing part 132.

A first driving mechanism constituted with a motor, a clutch, and the like which are controlled by the image formation control part 130A is connected to the photoreceptor 130*a*, which allows elements around the photoreceptor 130*a* to be controlled by the image formation control part 130A in a prescribed sequence to form a toner image on the photoreceptor.

A second driving mechanism constituted with a motor, a clutch, and the like which are controlled by the transportation control part 131A is connected to a roller and a transporting belt driving roller which constitute the paper feeding/transporting part 131*a* and the transferring/transporting part 131*b*.

A third driving mechanism 132*c* constituted with a motor, a clutch, and the like which are controlled by the fixation control part 132A that constitutes a transportation control part of the present invention is connected to the fixing roller 132*b*.

The digital copying machine 1 is provided with a device cover that can be opened/closed for carrying out maintenance to deal with a paper jam, to supply the toners, etc. The open/close state of the device cover is detected by a sensor, and it is inputted to the image output control part 13A.

As shown in FIG. 1, a first paper detecting part 133*a* and a second paper detecting part 133*b* for detecting presence of a paper are provided on an upstream side and a downstream side of the fixing part 132 along the transporting path of the paper, and detection signals from the first paper detecting part 133*a* and the second paper detecting part 133*b* are inputted to the fixation control part 132A. The first paper detecting part 133*a* and the second paper detecting part 133*b* are constituted with reflective-type or transmissive-type photosensors. However, it is also possible for those parts to be constituted with contact-type sensors or the like having an actuator that changes its posture depending on a paper, as long as the sensors are capable of detecting the presence of the paper.

When the second paper detecting part 133*b* disposed on the downstream side does not detect a paper within prescribed time T1 from a point where the first paper detecting part 133*a* disposed on an upstream side of the transporting path detects the paper, the fixation control part 132A detects that there is an occurrence of a paper jam in the fixing part. That is, the fixation control part 132A functions as a paper jam detecting part of the present invention.

The first prescribed time T1 can be set by Equation 1, where an isolated distance between the first paper detecting part 133*a* and the second paper detecting part 133*b* is D, and a transporting speed of the paper is V. In Equation 1, α is a detection margin of a paper jam in the fixing part, which is a grace time set for preventing a misdetection. Normally, it is set as about 0.1×D/V.

$$T1=D/V+\alpha \quad \text{[Equation 1]}$$

When the paper jam in the fixing part is detected by the fixation control part 132A, the heater is turned off. At the same time, the pressure roller 132*a* and the fixing roller 132*b* as the transporting mechanism are stopped via the third driving mechanism 132*c*.

If a paper is in a shorter size than the isolated distance D along the transporting direction, e.g. a post card, it is stuck while being sandwiched between a pair of the rollers 132*a* and 132*b*.

When a paper jam in the fixing part is detected by the paper jam detecting part and no paper is detected by the first paper detecting part 133*a*, the fixation control part 132A drive-controls a transporting mechanism to change a transporting direction of the paper to the reverse direction. Such control is executed when a transporting direction length L of the paper is smaller than a value obtained by adding a product of the detection margin α and the transporting speed V to the isolated distance D.

When a paper jam in the fixing part is detected and the rear end of the paper has passed the first paper detecting part, it is difficult for an operator to visually check the paper within the fixing part. Thus, the paper is not removed from the fixing part, which may result in giving critical damages to the device.

When the above-described structures are employed according to the present invention, it is possible even under such circumstances to drive-control the transporting mechanism in a reverse direction by the fixation control part 132A so as to transport a paper in the reverse direction from a normal transporting direction. Therefore, when a paper is detected by the first paper detecting part, the operator can visually recognize the paper. As a result, the paper can be easily removed, so that it is possible to avoid such a situation of giving damages to the fixing part beforehand.

Specifically, the fixation control part 132A executes: a first mode drive control upon detecting a paper jam in the fixing part; a second mode drive control when the digital copying machine 1 is reset after detecting the paper jam in the fixing part; and a third mode drive control with which the transporting direction is drive-controlled in the reverse direction, during the execution of the first mode drive control or the second mode drive control.

Figure 5:
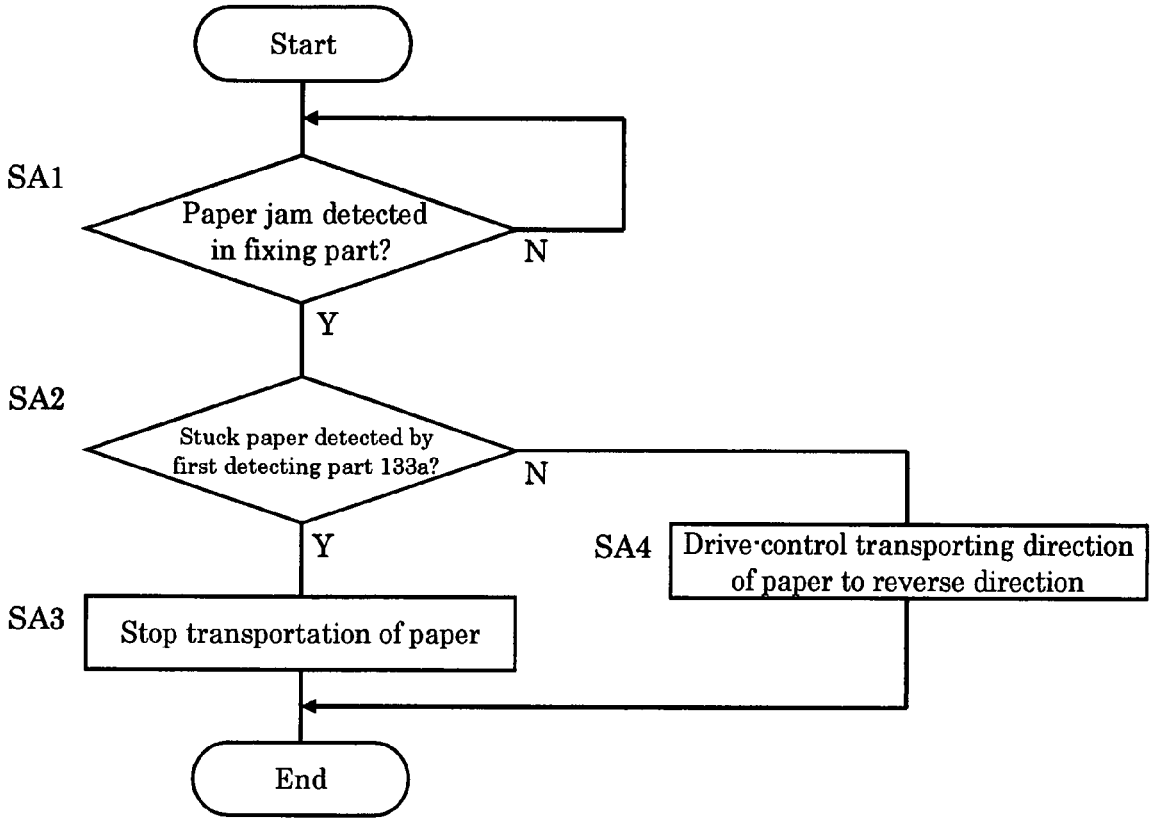
FIG. 5 is a flowchart showing a drive control of a fixing part executed by a fixation control part.

The first mode drive control will be described by referring to a flowchart shown in FIG. 5. At a point where a paper jam in the fixing part is detected by the fixation control part 132A (SA1), if the paper that has caused the paper jam in the fixing part is detected by the first detecting part 133*a* (SA2), the fixation control part 132A stops transporting the paper (SA3).

If the paper is not detected by the first detecting part 133*a* (SA2), the fixation control part 132A drive-controls the pressure roller 132*a* and the fixing roller 132*b* to change the transporting direction of the paper to the reverse direction (SA4). That is, the fixation control part 132A drive-controls the transporting mechanism to change the transporting direction of the paper to the reverse direction at a point where the paper jam in the fixing part is detected by the paper jam detecting part.

Figure 6:
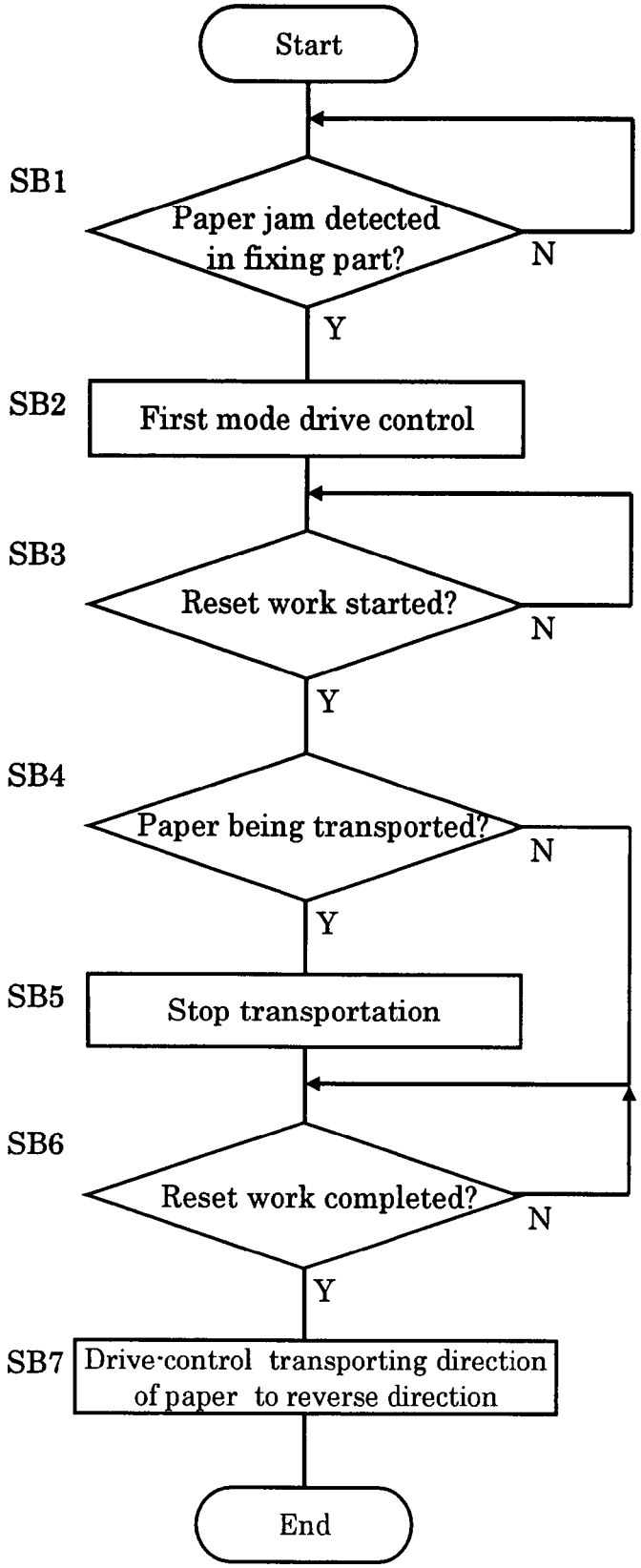
FIG. 6 is a flowchart showing the drive control of the fixing part executed by the fixation control part.

The second mode drive control will be described by referring to a flowchart shown in FIG. 6. At the point where a paper jam in the fixing part is detected by the fixation control part 132A (SB1), the first mode drive control is performed (SB2). When a reset work of the digital copying machine 1 by the operator is started, i.e. when the device cover is opened to remove the paper stuck in the fixing part, the power supply is cut out (SB3). If it is during the transportation of the paper (SB4), a transportation control is stopped (SB5).

In a case where the length of the paper that has caused the paper jam in the fixing part is short, the operator may not recognize the presence of the paper and returns the device to a normal state by removing only the paper remained in each part on the upstream side. In such a case, the stuck paper is not detected by the paper detecting part. Thus, even though a paper-jam state in the fixing part is not solved, the device is returned to the normal state as in a case of having removed the paper. This may cause critical damages to the fixing part in a latter image forming operation.

Thus, at a point where reset of the digital copying machine 1 is completed, i.e. at a point where the device cover is closed and the power supply is turned on again (SB6), the fixation control part 132A drive-controls the pressure roller 132*a* and the fixing roller 132*b* to change the transporting direction of the paper to the reverse direction (SB7). That is, the fixation control part 132A drive-controls the transporting mechanism to change the transporting direction of a paper to the reverse direction, after the paper jam in the fixing part is detected by the paper jam detecting part and at a point where the power supply is turned on again or where the device cover is opened/closed.

With the above-described structure, the transporting mechanism is drive-controlled to the reverse direction by the fixation control part 132A at the point where the power supply is turned on again or the device cover is opened/closed. Therefore, the paper jam in the fixing part can be detected by the first paper detecting part, so that it is possible to prevent an image forming operation from being executed by the operator who has misrecognized that the paper jam has been handled completely.

Figure 7:
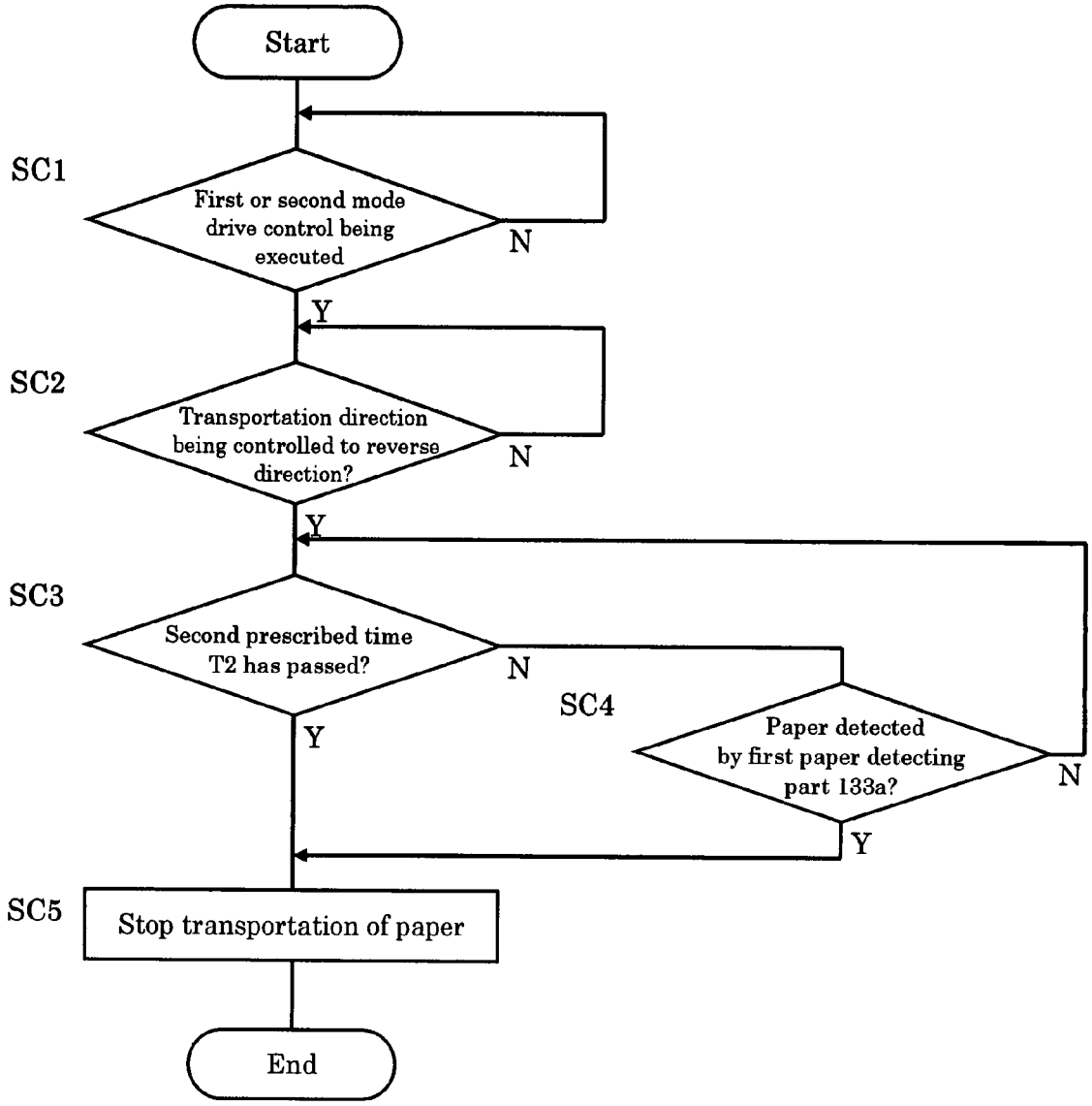
FIG. 7 is a flowchart showing the drive control of the fixing part executed by the fixation control part.

The third mode drive control will be described by referring to a flowchart shown in FIG. 7. When the first mode drive control or the second mode drive control is performed by the fixation control part 132A (SC1) and the transporting direction of the paper is controlled to the reverse direction (SC2), the pressure roller 132*a* and the fixing roller 132*b* is drive-controlled at least for a second prescribed time T2 within which the paper stuck in the fixing part is assumed to be detected by the first paper detecting part 133*a*. After a passage of the second prescribed time T2 (SC3), the pressure roller 132*a* and the fixing roller 132*b* are stopped (SC5).

Even before the passage of the second prescribed time T2 (SC3), if the first paper detecting part 133*a* detects a paper (SC4), the drive control to the reverse direction is stopped (SC5). That is, upon detecting the paper by the first paper detecting part when the transporting mechanism is drive-controlled to change the transporting direction of the paper to the reverse direction, the fixation control part 132A stops the drive control to the reverse direction. This makes it possible to shorten the time for performing the drive control of the transporting mechanism to the reverse direction, which is a cause for giving damages to the members that constitute the fixing part.

The second prescribed time T2 can be obtained by Equation 2, where an isolated distance between the first paper detecting part 133*a* and the second paper detecting part 133*b* is D, length of the paper along the transporting direction is L, and a transporting speed of the paper is V. It may also be set as a value obtained by adding the detection margin α described earlier to the value obtained thereby.

$$T2=(D-L)/V \quad \text{[Equation 2]}$$

Regarding the drive control of the pressure roller 132*a* and the fixing roller 132*b* by the fixation control part 132A, it is not necessary to execute all of the first mode drive control, the second mode drive control, and the third mode drive control. For example, the first mode drive control and the third mode drive control may be executed without executing the second mode drive control, or the second mode drive control and the third mode drive control may be executed without executing the first mode drive control. Furthermore, the first mode drive control and the second mode drive control may be executed without executing the third mode drive control.

However, when the third mode drive control is not executed, the fixation control part 132A drive-controls the pressure roller 132*a* and the fixing roller 132*b* to the reverse direction at least for the time that is expressed with Equation 2, which is assumed to be sufficient for allowing the operator to visually recognize the paper that has caused a paper jam in the fixing part.

The foregoing embodiment has been described by referring to a case where the fixation control part 132A embodies the transportation control part of the present invention which drive-controls the transporting mechanism to change the transporting direction of the paper to the reverse direction, when the paper jam in the fixing part is detected by the paper jam detecting part and the paper is not detected by the first detecting part. However, it may also be so constituted that the transportation control part 131A instead of the fixation control part 132A embodies the transportation control part of the present invention.

The foregoing embodiment has been described by referring to the case of the digital copying machine 1. However, the present invention can be applied not only to the digital copying machine but also to a printer, a facsimile machine, a composite machine, or the like, which includes a fixing part.

What is claimed is:

1. An image forming device, comprising:

a fixing part having a transporting mechanism that transports a paper, on which a toner image is formed, in a forward direction towards a downstream side while thermally fixing the toner image;

a first paper detecting part disposed on an upstream side of the fixing part;

a second paper detecting part disposed on a downstream side of the fixing part;

a paper jam detecting part that detects a paper jam in the fixing part when a paper is not detected by the second paper detecting part within a first prescribed time after the paper is detected by the first paper detecting part; and a transportation control part which drive-controls the transporting mechanism to effect the following operations during a period of transporting the paper in the forward direction:

changing a transporting direction of the paper to a reverse direction in response to concurrence of the following two conditions:

a paper jam in the fixing part being detected by the paper jam detecting part; and a rear end of the paper having passed the first paper detecting part so as not to be detected by the first paper detecting part at a time concurrent with indication of the paper jam by the paper jam detecting part; and stopping transport of the paper in response to concurrence of the following two conditions:

a paper jam in the fixing part being detected by the paper jam detecting part; and the paper being detected by the first detecting part at a time concurrent with indication of the paper jam by the paper jam detecting part.

2. The image forming device according to claim 1, wherein the transportation control part drive-controls the transporting mechanism to change the transporting direction of the paper to the reverse direction, at a point where the paper jam in the fixing part is detected by the paper jam detecting part.

3. The image forming device according to claim 1, wherein the transportation control part drive-controls the transporting mechanism to change the transporting direction of the paper to the reverse direction, at a point where a power supply is turned on again or a device cover is opened/closed after the paper jam in the fixing part is detected by the paper jam detecting part.

4. The image forming device according to claim 1, wherein the transportation control part drive-controls the transportation mechanism to effect the change of the transporting direction of the paper to the reverse direction at least for a second prescribed time within which the paper should be detected by the first paper detecting part based on on distance and travel speed.

5. The image forming device according to claim 1, wherein if the paper is detected by the first paper detecting part after the transporting mechanism is drive-controlled to effect the change the transporting direction of the paper to the reverse direction, the transportation control part stops the drive control in the reverse direction to cease transport of the paper.

6. A paper jam handling method for an image forming device, comprising:

a paper transporting step which transports a paper, which is transported in a forward direction from an upstream side to a fixing part, to a downstream side;

a paper jam detecting step which detects a paper jam in the fixing part, when the paper is not detected by a second paper detecting part that is disposed on a downstream side of the fixing part within a first prescribed time after the paper is detected by a first paper detecting part that is disposed on an upstream side of the fixing part; and the paper transporting step further including effecting the following operations during a period of transporting the paper in the forward direction:

changing a transporting direction of the paper to a reverse direction in response to concurrence of the following two conditions:

detecting a paper jam in the fixing part by execution of the paper jam detecting step; and determining, in response to the detecting of the paper jam, that the first paper detecting part is not detecting a rear end of the paper which passed the first paper detecting part so as not to be detected by the first paper detecting part; and stopping transport of the paper in response to concurrence of the following two conditions:

detecting a paper jam in the fixing part by the paper jam detecting step; and determining, in response to the detecting of the paper jam, that the paper detecting part is detecting the paper.

7. The paper jam handling method for an image forming device according to claim 6, wherein the changing the transporting direction of the paper to the reverse direction operation is executed at the point where the paper jam in the fixing part is detected by the paper jam detecting step, and/or at a point where a power supply is turned on again or a device cover is opened/closed after the paper jam in the fixing part is detected by the paper jam detecting step.

8. The paper jam handling method for an image forming device according to claim 6, wherein the changing the transporting direction of the paper to a reverse direction operation is executed at least for a second prescribed time within which the paper should be detected by the first paper detecting part based on distance and travel speed, and/or the transport the paper in the reverse direction is stopped when the paper is detected by the first paper detecting part.

9. An image forming device, comprising:

a fixing part having a transporting mechanism that transports a paper, on which a toner image is formed, in a forward direction towards a downstream side while thermally fixing the toner image;

a first paper detecting part disposed on an upstream side of the fixing part;

a second paper detecting part disposed on a downstream side of the fixing part;

a paper jam detecting part that detects a paper jam in the fixing part when a paper is not detected by the second paper detecting part within a first prescribed time after the paper is detected by the first paper detecting part; and a transportation control part which drive-controls the transporting mechanism to effect the following:

changing a transporting direction of the paper from the forward direction to a reverse direction in response to both of the following conditions being met: a paper jam in the fixing part is detected by the paper jam detecting part, and while the paper jam is detected determining that a rear end of the paper has passed the first paper detecting part based on the paper not being detected by the first paper detecting part; and stopping transport of the paper in the forward direction in response both of the following two conditions being met: a paper jam in the fixing part being detected by the paper jam detecting part; and the paper being detected by the first detecting part at a time concurrent with indication of the paper jam by the paper jam detecting part.

10. The image forming device according to claim 9, wherein the transportation control part drive-controls the transporting mechanism to change the transporting direction of the paper to the reverse direction, at a point where a power supply is turned on again or a device cover is opened/closed after the paper jam in the fixing part is detected by the paper jam detecting part.

11. The image forming device according to claim 9, wherein the transportation control part drive-controls the transportation mechanism to change the transporting direction of the paper to the reverse direction at least for a second prescribed time which approximates a time for the paper to travel back to the first paper detecting part.

12. The image forming device according to claim 11, wherein the transportation control part aborts drive-control of the transporting mechanism in the reverse direction before expiration of the second prescribed time when the paper is detected by the first paper detecting part subsequent to said change in transporting direction to the reverse direction.

13. An image forming device, comprising:

a fixing part having a transporting mechanism that transports a paper on which a toner image is formed towards a downstream side while thermally fixing the toner image;

a first paper detecting part disposed on an upstream side of the fixing part;

a second paper detecting part disposed on a downstream side of the fixing part;

a paper jam detecting part that detects a paper jam in the fixing part when a paper is not detected by the second paper detecting part within a first prescribed time after the paper is detected by the first paper detecting part; and a transportation control part which drive-controls the transporting mechanism to change a transporting direction of the paper to a reverse direction when both of the following conditions are met: a paper jam in the fixing part is detected by the paper jam detecting part, and while the paper jam is detected the paper is not detected by the first paper detecting part, wherein:

the transportation control part drive-controls the transportation mechanism to change the transporting direction of the paper to the reverse direction at least for a second prescribed time which approximates a time for the paper to travel back to the first paper detecting part; and the transportation control part aborts drive-control of the transporting mechanism in the reverse direction before expiration of the second prescribed time when the paper is detected by the first paper detecting part subsequent to said change in transporting direction to the reverse direction.

14. A paper jam handling method for an image forming device, comprising:

transporting a paper from an upstream side to a downstream side of a fixing part;

detecting a paper jam in the fixing part, when the paper is not detected by a second paper detecting part that is disposed on a downstream side of the fixing part within a first prescribed time after the paper is detected by a first paper detecting part that is disposed on an upstream side of the fixing part;

after said paper jam detecting, checking the first paper detecting part for said paper;

reverse-transporting the paper in a reverse direction in response to both of the following conditions being met:

detecting the paper jam in the fixing part by the paper jam detecting step; and determining, in response to the detecting of the paper jam, that a rear end of the paper has passed the first paper detecting part based on the paper not being detected by the first paper detecting part during said checking; and stopping transport of the paper in response to both of the following two conditions being met:

detecting a paper jam in the fixing part by the paper jam detecting step; and determining, in response to the detecting of the paper jam, that the first paper detecting part is detecting the paper during said checking.

15. The paper jam handling method for an image forming device according to claim 14, wherein the reverse-transporting step is executed at one of the following times after the paper jam is detected: a first time when a power supply is turned on again, and a second time when a device cover is opened/closed.

16. The paper jam handling method for an image forming device according to claim 14, further comprising aborting the reverse-transporting of the paper, before expiration of a second prescribed time, when the paper is detected by the first paper detecting part subsequent to said change in transporting direction to the reverse direction.

* * * * *